United States Patent [19]

Harrison et al.

[11] Patent Number: 5,038,776

[45] Date of Patent: Aug. 13, 1991

[54] UNIVERSAL HEAD HARNESS

[75] Inventors: Brian H. Harrison, Nepean; Lorne A. Main; James A. Newman, both of Gloucester; Jocelyn B. Pedder; Nicole Ranger, both of Ottawa; Brian Gallup, Kanata; André M. St. Laurent, Gloucester; Donald Gray, Langley, all of Canada

[73] Assignee: Her Majesty the Queen in right of Canada, as represented by the Minister of National Defence of Her Majesty's Canadian Government, Ottawa, Canada

[21] Appl. No.: 359,502

[22] Filed: May 31, 1989

[30] Foreign Application Priority Data

Jul. 8, 1988 [CA] Canada ..... 571574

[51] Int. Cl.[5] ..... A62B 18/08

[52] U.S. Cl. ..... 128/207.11; 128/201.23; 128/206.12; 2/173

[58] Field of Search ..... 128/207.11, 206.11, 128/206.24, 206.27, 206.28, 201.26, 201.27, 201.28, 201.29, 202.11, 201.22, 201.23, 201.24, 201.25, 206.12; 2/173, 6, 9, 424

[56] References Cited

U.S. PATENT DOCUMENTS

| | | | |
|---|---|---|---|
| 2,058,989 | 10/1936 | Isaac | 2/173 |
| 2,809,374 | 11/1952 | Reed | 2/6 |
| 2,821,192 | 1/1958 | Monro | 128/201.25 |
| 3,043,299 | 7/1962 | Potash | 128/207.11 |

FOREIGN PATENT DOCUMENTS

| | | |
|---|---|---|
| 463397 | 2/1946 | Belgium . |
| 839043 | 3/1939 | France . |

*Primary Examiner*—Edgar S. Burr
*Assistant Examiner*—Stephen R. Funk
*Attorney, Agent, or Firm*—William R. Hinds

[57] ABSTRACT

Head harness form gas mask consists of several pieces of biaxially stretchable elastic fabric stitched together to provide a concave configuration in the relaxed state. The harness is shaped and sized to fit a range of normal human heads by stretching over the back and top of the head. The forward edge of the harness has a number of tongues of the elastic fabric that attach to a gas mask. The preferred material for the harness is a 280 denier bare spandex power net fabric that has a flat load versus elongation curve. A gas mask fitted with the harness applies a uniform pressure within the comfort range on the face of the wearer without significant adjustment of the harness, despite wide ranges in the head size and configuration of the wearer.

16 Claims, 5 Drawing Sheets

LOAD V. EXTENSION - PRIOR ART STRAPS

LOAD V. EXTENSION - HARNESS MATERIAL

UNIVERSAL HEAD HARNESS

This application relates to a head harness for gas masks.

The most commonly used head harness for gas masks is a multi-layered pad of textile fabric material that seats on the back of a wearer's head and several adjustable rubber or elastic straps projecting from the pad to the perimeter of the gas mask. This arrangement requires that each strap be individually adjusted when the mask is put on. Improper adjustment produces a non-uniform pressure on the face, or a pressure that is uncomfortably high or too low. The strap adjustment is thus critical. In addition, the pad and straps cause pressure points on the head making wear for long periods of time very uncomfortable. The adjusting buckles for the straps may also interfere with the equipment such as various helmets that may be worn, thus further increasing discomfort.

The present invention is concerned with the provision of a new head harness for gas masks.

According to one aspect of the present invention there is provided a head harness for a gas mask comprising a plurality of pieces of biaxially stretchable elastic fabric stitched together to provide a concave configuration in the relaxed state, shaped and sized to fit a range of normal human heads, the harness having a forward edge with a plurality of tongues of the elastic fabric spaced therealong for attachment to a gas mask.

According to another aspect of the present invention, there is provided a gas mask incorporating a head harness of this type.

The elastic harness applies a substantially uniform pressure over the back and top of the head, thus eliminating high local pressures on the head and significantly improving comfort. It also applies substantially equal force to the attachment points of the gas mask, thus providing a good seal with the face. By using suitable materials for the harness, the requirement for adjustment buckles can be eliminated or limited to two below the ears, attached to a strap along the back edge of the harness. The preferred material has a flat load to extension curve, meaning that over a wide range of extensions the load is relatively constant. Consequently, the harness fits a range of head sizes without the need for adjustment. This effect is particularly good when using a 200 denier bare spandex power net fabric.

In the accompanying drawings which illustrate a prior art head harness and an exemplary embodiment of the present invention:

Figure 1:
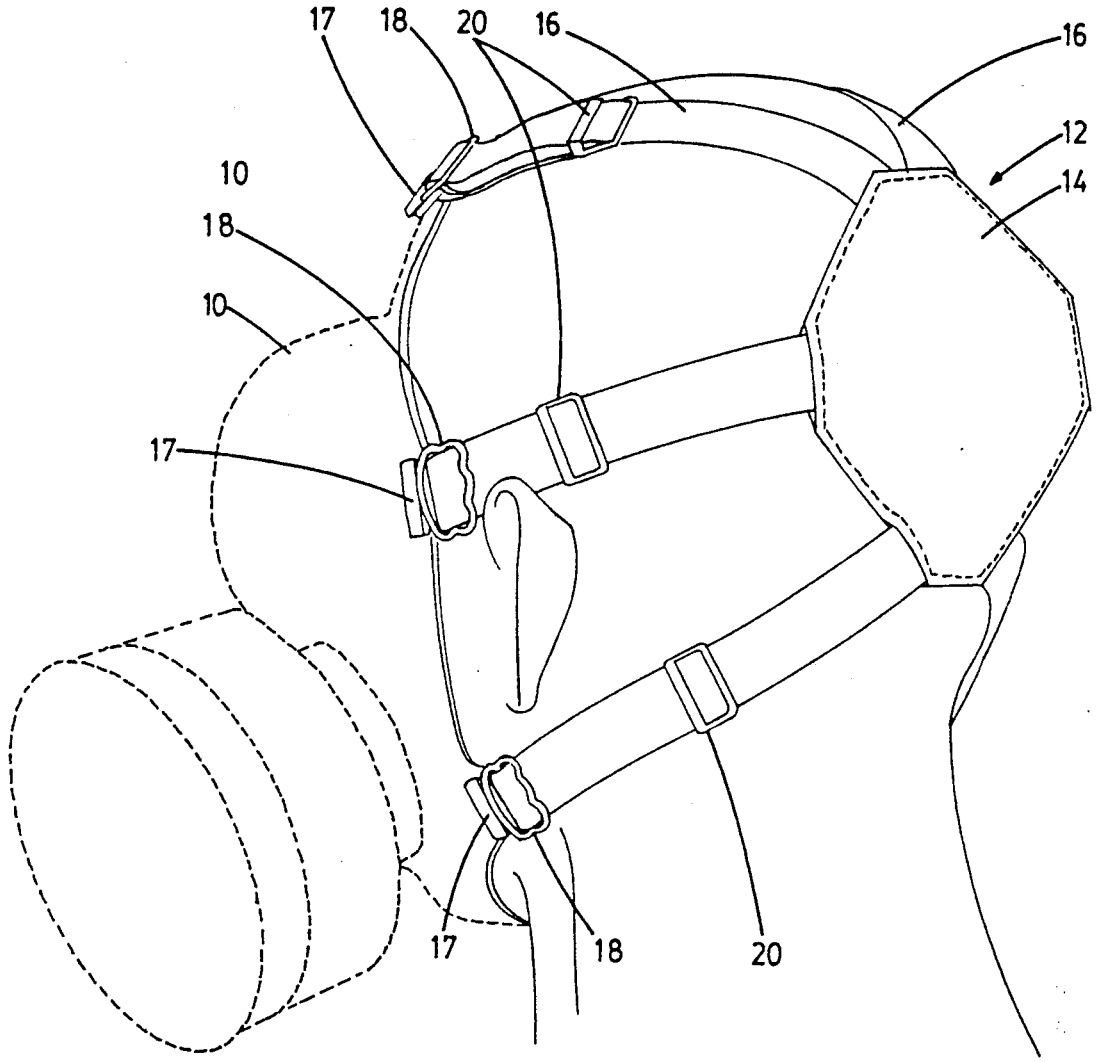
FIG.1 (PRIOR ART)
FIG. 1 is a pictorial representation of a prior art head harness as it is worn.
Figure 2:
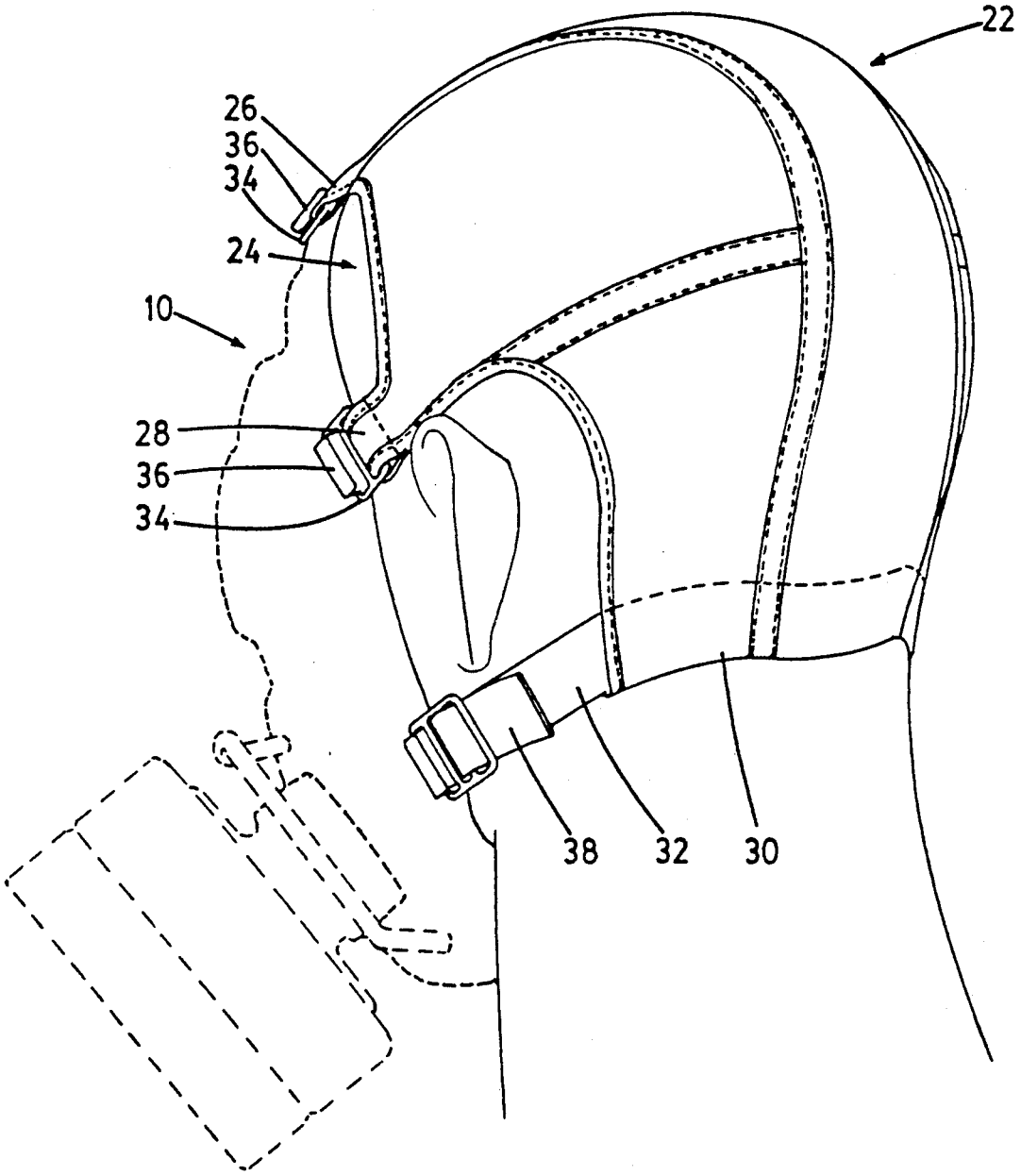
FIG. 2 is a pictorial representation like FIG. 1 of a head harness according to the present invention.

Referring to the drawings, and in particular to FIG. 1, there is illustrated a gas mask 10 attached to a prior art head harness 12. The mask per se may be conventional with a rubber face piece fitted with eyepieces, a voicemitter and a canister. The head harness consists of a pad 14 that is generally square, with truncated corners, and six elastic straps 16 extending from the corners of the pad. The straps are connected to the mask 10 at respective anchor points 17 distributed about the periphery of the mask. At the attachment points the elastic straps 16 are threaded through buckles 18, and their ends are folded back on the standing parts of the straps to pass through secondary buckles 20 on the straps.

Figure 11:
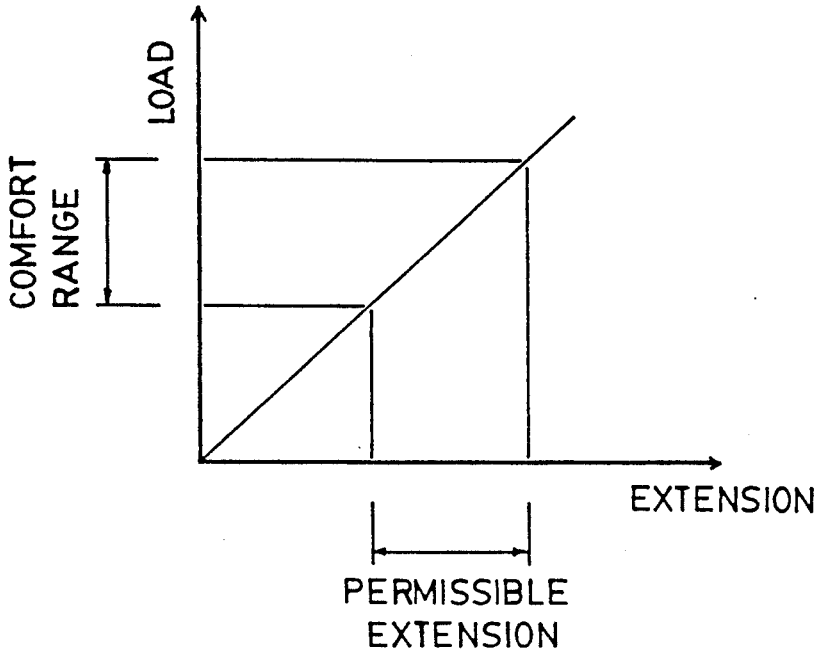
FIG. 11 is a load versus extension curve of the prior art elastic straps.

With the illustrated prior art harness, there is a pressure point at the back of the head, just below the crown and pressure points along the elastic straps, especially where the buckles are located. The various buckles and the thick pad interfere with the wearing of a helmet. In putting the gas mask on, it is necessary to adjust all of the straps 16 to provide a uniform pressure of the gas mask face piece on the face, all around its perimeter. This adjustment is critical because the material of the straps has an almost linear load versus extension curve as shown in FIG. 11.

A head harness according to the present invention is illustrated in FIGS. 2 through 10. The illustrated harness is constructed in the form of a coif, that is a close cap covering the top, back and sides of the head. The coif is made of a biaxially stretchable elastic textile fabric and has a concave configuration in the relaxed state, the shape being such as to fit a range of normal human heads.

The harness has a forward edge 24 that is formed with two tongues 26 near the top of the harness and two side tongues 28, all of which project towards the mask for securement to its attachment points. Along the back edge 30 of the harness is a fabric strap 32 that also extends to the front of the harness, towards the mask.

The tongues 26 and 28 are permanently secured to non-adjustable buckles 34. Each tongue is passed through an opening 35 in the buckle, folded back on itself and stitched in place. Rectangular openings 37 in the buckles fit over attachment lugs 36 on the mask. The strap 32 has its ends attached to adjustable buckles 38 that are also connected to attachment lugs 36. As illustrated most particularly in FIG. 2, the attachment lugs for tongues 26 are on the top of the head, the attachment lugs for tongues 28 are at the temples, and the attachment lugs for the strap 32 are below the ear, near the point of the wearer's jaw.

Figure 5:
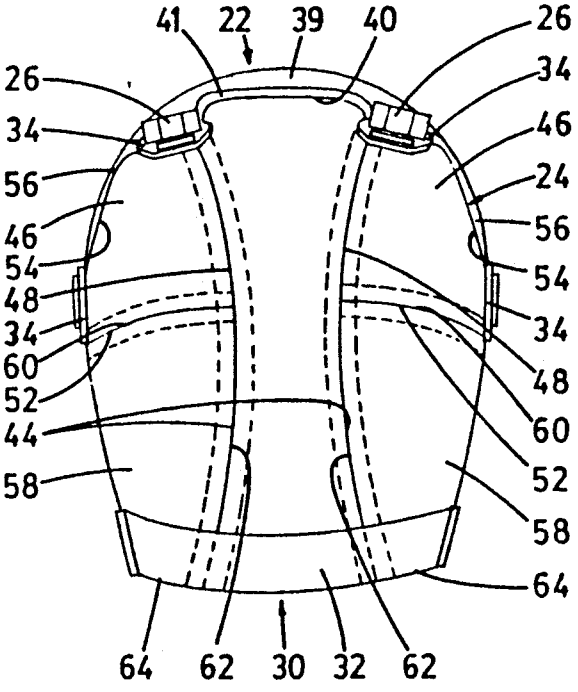
FIG. 5 is front elevation of the head harness of FIG. 2.
Figure 4:
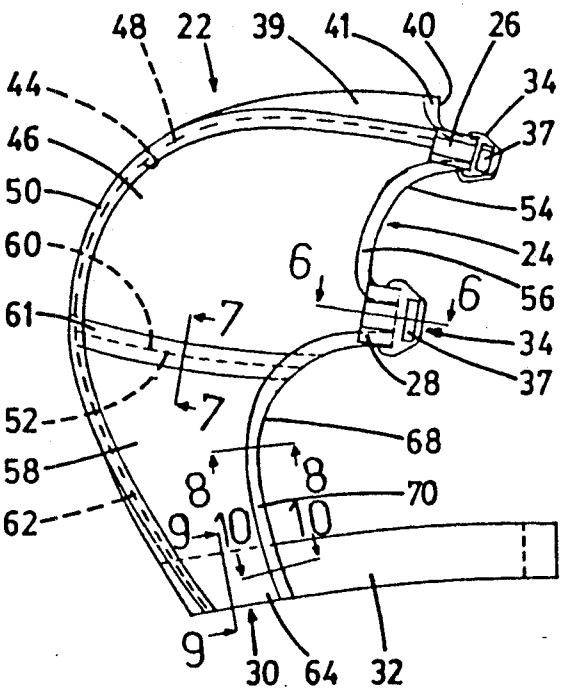
FIG. 4 is a side elevation of the head harness of FIG. 2.
Figure 3:
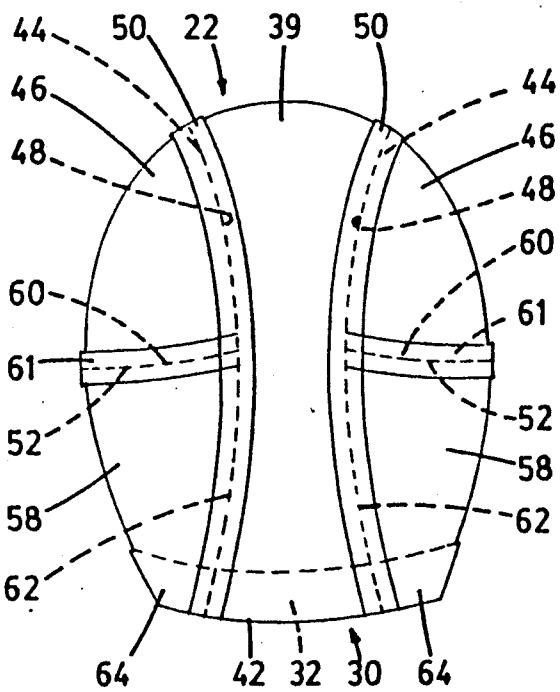
FIG. 3 is a back elevation of the head harness of FIG. 2.
Figure 12:
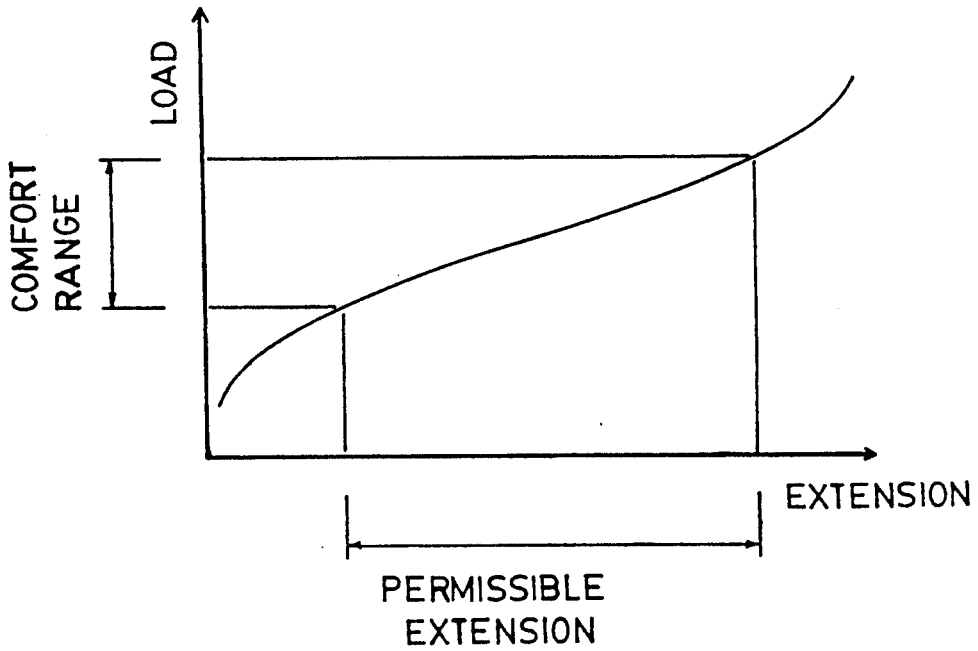
FIG. 12 is a load versus extension curve of the preferred material of the present harness.

As most particularly illustrated in FIGS. 3, 4, and 5, the harness consists of five panels of material, connected together to provide the desired concave shape. The material employed is a power net fabric, desirably a bare spandex power net fabric. The preferred material is a 280 denier bare spandex power net fabric such as that sold under the name Raschel Power Net No. 9-2158 by Britex Ltd. of Bridgetown, Nova Scotia, Canada. This material has a relatively flat load versus extension curve as illustrated in FIG. 12. This means that adjustment of the harness is no longer a critical factor as the material applies a substantially uniform pressure throughout its normal range of extensions.

The five panels of the harness include a center panel 39 with a slightly concave forward edge 40 covered with a binding tape 41, a back edge 42 forming the center of the back edge 30 of the harness and two concave side edges 44.

Two temple panels 46 are located on opposite sides of the center panel, at the top, with the top edges 48 of the temple panels extending along the side edges 44 of the center panel. The edges 48 and 44 are secured together and covered with an elastic binding tape 50. The temple panel also has a bottom edge 52 and a forward edge 54 that is finished with a binding tape 56.

Two back panels 58 are located below the temple panels, with the top edge 60 of each back panel secured to the bottom edge 52 of the associated temple panel, with the seam being secured and covered by an elastic binding tape 61. The back edge 62 of each back panel extends along the adjacent side edge 44 of the center panel and is secured thereto with the seam being covered by the binding tape 50 that also covers the seam between the side edge of the center panel and the top edge of the temple panel. The bottom edge 64 of the back panel provides a continuation of the back edge 42 of the center panel. The strap 32 extends along the back edge, on the inside of the panels 58 and 39. The forward edge 68 of each back panel is concave and offset to the back to be located clear of the ear of a wearer when in use. The edge 68 is covered with a binding tape 70.

Figure 6:
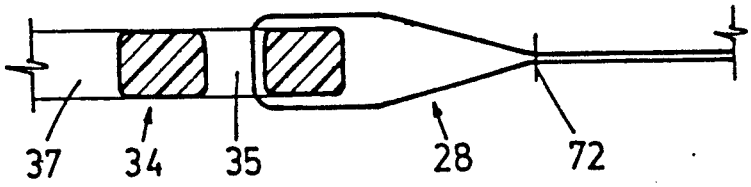
FIG. 6 is a view along the line of 6—6 of FIG. 4.

Referring to FIG. 6, this illustrates the manner in which the buckles 34 are secured to the tongues 26 and 28. FIG. 6 illustrates one of the tongues 28 in particular, but the method of connection is the same for the other tongues as well. As can be seen, the tongue 28 is looped through the opening 35 in the buckle, folded back on itself and stitched as at 72.

Figure 7:
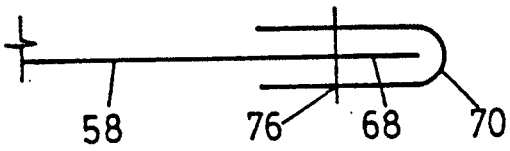
FIG. 7 is a sectional view along the line of 7—7 of FIG. 4.

FIG. 7 is a cross-sectional view of the forward edge of the back panel 58. As can be seen, the binding tape 70 is wrapped around the forward edge 68 of the panel fabric and stitched in place by a line of stitches 76. This is preferably a single needle zigzag stitch.

Figure 8:
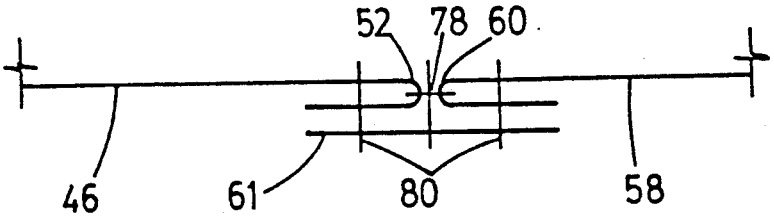
FIG. 8 is a sectional view along the line of 8—8 of FIG. 4.

FIG. 8 illustrates the seam between a temple panel 46 and a back panel 58. The fabric edges of the two panels are folded over and stitched together at 78 using a single needle chain stitch. The elastic binding tape 61 overlies the folded over edges of the fabric panels and is stitched to them by two lines of stitching 80.

Figure 9:
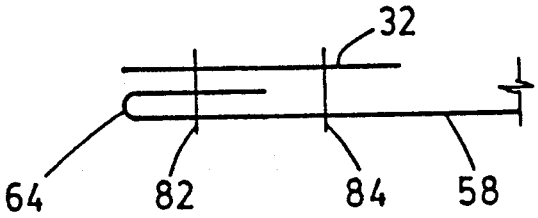
FIG. 9 is a sectional view along the line of 9—9 of FIG. 4.

FIG. 9 illustrates the manner in which the strap 32 is secured to the bottom edge of the back panel 58. The edge of the fabric panel 58 is folded over to the inside and the strap 32 is stitched to the inside, overlying the folded over edge by a single needle zigzag line of stitches 82. A second single needle zig- zag line of stitches 84 secures the strap 32 to the body of the fabric 58 above the folded over edge section.

Figure 10:
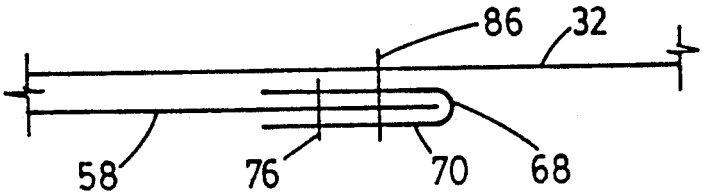
FIG. 10 is a sectional view along the line of 10—10 of FIG. 4.

FIG. 10 illustrates in section the junction of the back panel 58, the strap 32 and the binding tape 70 on the forward edge of the back panel. The binding tape 70 is secured to the panel edge as illustrated in FIG. 7, while the strap 32 is tacked in place by a series of stitches schematically illustrated at 86.

The remaining seams and edges in the harness are formed in the manner illustrated in FIGS. 7 through 10.

As will be observed, the tongues 26 are formed in the harness at the seams between the center panel 39 and the temple panels 46. The tongues 28 are formed adjacent the bottom of the temple panels 46, with the bottom edge of the tongues generally in line with the seam between the temple panel and the back panel.

In putting on a gas mask equipped with the illustrated harness, the strap 32 is loosened on both sides, if necessary, the face piece of the mask is located over the face and the harness is stretched over the head, much like donning a balaclava or stocking cap. The straps 32 may then be tightened to adjust the mask and harness to suit the comfort of the wearer.

By making the harness in this way, the pressure on the various attachment points of the gas mask is uniform, so that the mask fits the face well. At the same time, the harness exerts a uniform pressure over a large part of the wearer's head, so that there are no significant pressure points causing discomfort. The freedom from buckles and large pads allows the wearer to use any kind of helmet or other head gear that may be suitable for the task at hand. The fabric breathes and consequently there is little heat build-up due to its use. The harness is intended to be worn for long periods of time, up to 24 hours, without causing undue discomfort to a wearer.

While one embodiment of the invention has been explained in the foregoing, it is to be understood that other embodiments are possible within the scope of the present invention. For example, some embodiments may be constructed using additional tongues formed from the stretchable fabric material rather than the bottom adjustable strap 32.

We claim:

1. A head harness for a gas mask comprising a plurality of pieces of biaxially stretchable elastic fabric stitched together to provide a concave configuration in the relaxed state, shaped and sized to fit a range of normal human heads, the harness having a forward edge with a plurality of tongues of the elastic fabric spaced therealong, a plurality of buckles non-adjustably secured to respective ones of the tongues for fixed, non-adjustable attachment to a gas mask, a strap along a back edge of the harness and projecting forwardly therefrom and adjustable buckle means adjustably attached to the strap for attachment to the gas mask.

2. A harness according to claim 1 wherein the elastic fabric comprises a power net fabric.

3. A harness according to claim 1 wherein the elastic fabric comprises a bare spandex power net fabric.

4. A harness according to claim 1 wherein the fabric comprises a 280 denier bare spandex power net fabric.

5. A harness according to claim 1 wherein the harness comprises five panels of the biaxially stretchable elastic fabric.

6. A head harness for a gas mask comprising five panels of biaxially stretchable elastic fabric stitched together to provide a concave configuration in the relaxed state, shaped and sized to fit a range of normal human heads, the harness having a forward edge with a plurality of tongues of the elastic fabric spaced therealong for attachment to a gas mask, wherein the five panels include:

a centre panel with back and forward edges forming centre portions of the forward and back edges respectively of the harness and two concave side edges;

two temple panels on respective sides of the centre panel, each with a convex top edge seamed to a forward portion of the adjacent side edge of the centre panel, a forward edge forming a portion of the forward edge of the harness, and a bottom edge extending between the top and forward edges; and two back panels on respective sides of the centre panel, below the temple panels, each having a top edge seamed to the bottom edge of the adjacent temple panel, a back edge seamed to the side edge of the centre panel, between the adjacent temple panel and the back edge of the harness, a bottom edge forming side portions of the back edge of the harness, and a concave front edge configured to be located, in use, behind the ear of the wearer.

7. A harness according to claim 6 including an elastic binding tape extending along and secured to each of the seams between adjacent panels.

8. A harness according to claim 7 including an elastic binding tape extending along and secured to the forward edge of the center and each temple and back panel.

9. A harness according to claim 8 wherein two of said tongues are formed at the seams between the center panel and the temple panels.

10. A harness according to claim 9 wherein a further of said tongues is formed at the bottom of the forward edge of each temple panel.

11. A harness according to claim 6 including a strap extending along and secured to the back edge of the harness and projecting forwardly from the harness, and means for adjustably attaching said strap to a mask.

12. A harness according to claim 9 including a strap extending along and secured to the back edge of the harness and projecting forwardly from the harness, and means for adjustably attaching said strap to a mask.

13. A gas mask comprising a rubber face piece for covering the full face of a wearer and a head harness for holding the face piece on the face of a wearer, said head harness comprising a plurality of pieces of biaxially stretchable elastic fabric stitched together to provide a concave configuration in the relaxed state, shaped and sized to fit a range of normal human heads, the harness having a forward edge with a plurality of tongues of the elastic fabric spaced therealong, means attaching the tongues non-adjustably to the face piece at positions spaced thereabout, a strap along a back edge of the harness and projecting forwardly therefrom, and means adjustably attaching the strap to the face piece.

14. A gas mask according to claim 13 wherein the harness comprises five panels of biaxially stretchable elastic fabric, including:

a center panel with forward and back edges forming center portions of the forward and back edges respectively over the harness and two concave side edges;

two temple panels on respective sides of the center panel, each with a convex top edge seamed to a forward portion of the adjacent side edge of the center panel, a forward edge forming a portion of the forward edge of the harness, and a bottom edge extending between the top and forward edges; and two back panels on respective sides of the center panel, below the temple panels, each having a top edge seamed to the bottom edge of the adjacent temple panel, a back edge seamed to the side edge of the center panel, between the temple panel and the back edge of the harness, a bottom edge joining the side portions of the back edge of the harness, and a concave front edge, configured to be located, in use, behind the ear of a wearer.

15. A gas mask according to claim 14 wherein two of said tongues are formed at the seams between the center panel and the temple panels.

16. A gas mask according to claim 15 wherein a further one of said tongues is formed at the bottom of the forward edge of each temple panel.

* * * * *